United States Patent [19]

Widmer

[11] 4,326,770

[45] Apr. 27, 1982

[54] ELECTRODE CLAMP

[75] Inventor: Colin F. Widmer, Middlesbrough, England

[73] Assignee: James Brown & Sons, Ltd., Great Britain

[21] Appl. No.: 210,139

[22] Filed: Nov. 24, 1980

Related U.S. Application Data

[63] Continuation of Ser. No. 37,294, May 9, 1979, abandoned.

[51] Int. Cl.[3] ..... H01R 13/22

[52] U.S. Cl. ..... 339/278 C; 339/273 F

[58] Field of Search ..... 339/263 E, 273 R, 273 F, 339/278 R, 278 C; 403/DIG. 5; 339/5, 6, 8

[56] References Cited

U.S. PATENT DOCUMENTS

| | | | |
|---|---|---|---|
| 1,008,002 | 11/1911 | Allen | 403/DIG. 5 |
| 2,820,084 | 1/1958 | Shaw | 339/273 |
| 2,836,806 | 5/1958 | Stroup | 339/263 E |
| 3,030,544 | 4/1962 | Zamboldi et al. | 403/DIG. 5 |
| 3,215,974 | 11/1965 | Wooding | 339/263 E |

*Primary Examiner*—Joseph H. McGlynn

[57] ABSTRACT

An electrical contact assembly between two conducting elements disposed face to face comprises wedge-shaped graphite inserts (26) located in similarly shaped grooves (22) in one of the faces (20). One end of each insert (26) lies short of the end of the groove (22) and the other end is proud of the face (20), so as to make good electrical contact with the other face (34) when the two faces (20,34) are pressed together. The invention achieves good electrical contact and conduction of current in applications where this has proved difficult in the past. Particular examples are clamps for graphite electrodes and connections to steel billets used as electrodes in an electro slag refining process.

11 Claims, 6 Drawing Figures

Fig. 3.
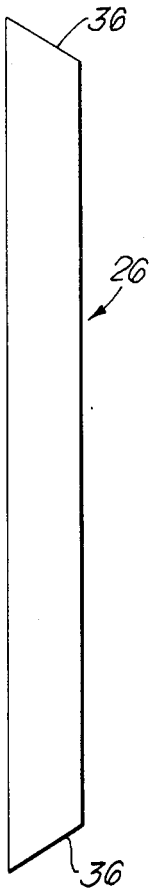
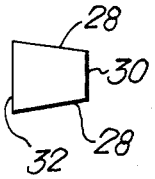
Fig. 4.
Fig. 5.
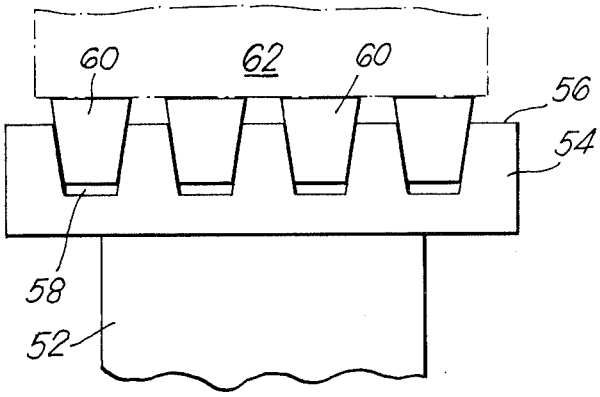
Fig. 6.
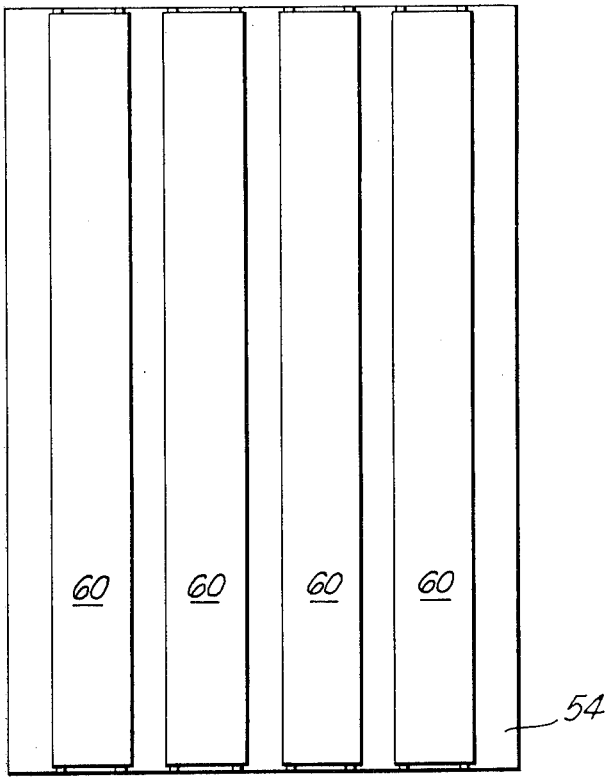

ELECTRODE CLAMP

This is a Continuation Application of Ser. No. 37,294 filed May 9, 1979, now abandoned.

FIELD OF THE INVENTION

The present invention relates to contact assemblies and seeks to provide a contact assembly which will give an adequate electrical contact between two conducting elements disposed in face to face relationship and which will permit satisfactory passage of electricity and heat without demanding impracticably fine tolerances in manufacture of the various parts.

BACKGROUND OF THE INVENTION

There are various applications in which electrical currents must be passed between two opposed faces which are clamped together or biassed towards each other by spring force or gravity or the like, a particular and important example being the feeding of electrical current to an electrode.

Clamps for cylindrical graphite electrodes, such as are used on an electric arc furnace, are normally made from cast or wrought copper and often include passages for water cooling.

In recent years, and in order to reduce the consumption of the graphite electrode, a technique has been developed of coating the graphite with aluminium and a large number of electric arc furnaces have been converted to use the aluminium coated type of electrodes. This has produced the result that, whereas previously a direct copper contact was satisfactory between the clamp and the electrode, a different system had to be devised for the aluminium coated electrode, because it is impracticable to make contact between copper and aluminium, particularly in hot conditions.

For this reason the present practice is to provide the electrode clamp with two graphite pads to give the required electrical contact between the clamp and the coating of the electrode.

This has given rise to disadvantages in that the large surface areas of both the curved and the flat faces demand a high degree of dimensional and angular accuracy which is vital in order to achieve good electrical and thermal transfers. In practice it is found that the tolerances of the various parts cannot be kept within such strict limits as to ensure good contact surfaces. Furthermore, it is difficult to ensure dirt is not trapped between the copper and the graphite insert. This in turn results in a poor transfer of heat and in arcing, and this in turn damages the copper electrode clamp.

Another type of connection is to be found in the electro slag refining process, where the electrode is constituted by a steel billet. Electric current is fed to this billet through a stainless steel pad which is welded onto the top of a stainless steel bar which in turn is welded to the top of the billet. The stainless steel pad is supported on a fork which carries the weight of the assembly and through which the vertical height can be controlled so that an arc is maintained on the bottom of the electrode.

At the present time, in order to connect one phase of the electrical supply to each of the three billets representing the three electrodes, a copper stub clamp is used which is shaped to form two-line contacts with the top face of the stainless steel pad and which is mechanically loaded with approximately nine tons to maintain the necessary electrical contact between the copper stub clamp and the steel pad and also to retain the pad securely on the fork. Owing to the relatively low conductivity of stainless steel, it is often found that when a large current is applied between the line-contacts of the stub clamp and the surface of the stainless steel pad, there is local over-heating and subsequent damage to the contact faces.

SUMMARY OF THE INVENTION

The present invention, inter alia, enables a more efficient system for electrical supply to both these different types of electrode.

According to the present invention we provide a contact assembly capable of passing large electrical currents, the assembly comprising two conducting elements disposed face to face, a plurality of insert-receiving grooves in one of the faces, each groove having opposed side walls which converge away from the face, a plurality of wedge-shaped graphite inserts in the grooves, each insert being shaped to fit between the convergent walls of a groove, leaving one end of the insert spaced from the end of the groove and the other end of the insert proud of the said one face, the said other end of the insert being of a shape to make electrical contact with the other of the faces, and means whereby the two conducting elements press towards each other giving good electrical contact between the graphite inserts and the two conducting elements and thereby a path for the electrical current from one conducting element to the other through the graphite inserts.

It is preferred that at least four carbon inserts be used. The wedge angle between the side walls of the grooves and of the graphite inserts should be such as to give sufficiently firm pressure between the graphite inserts and the sides of the groove on the one hand and the said other of the faces on the other hand to provide adequate electrical contact between these parts, whilst permitting slight movement of the inserts under pressure to take up any inaccuracies in the said other of the faces.

BRIEF DESCRIPTION OF DRAWINGS

The invention will now be described in further detail with reference to the accompanying drawings, wherein:

FIG. 3 and FIG. 4 are a side view and end view respectively of one of the graphite inserts of the clamp;

FIG. 5 is a side view of the upper end of the support and contact for an electrode billet for the electro slag refining process, showing the electrical connection thereto, being a contact assembly according to the present invention; and FIG. 6 is a plan view thereof.

DESCRIPTION OF PREFERRED EMBODIMENTS

Figure 1:
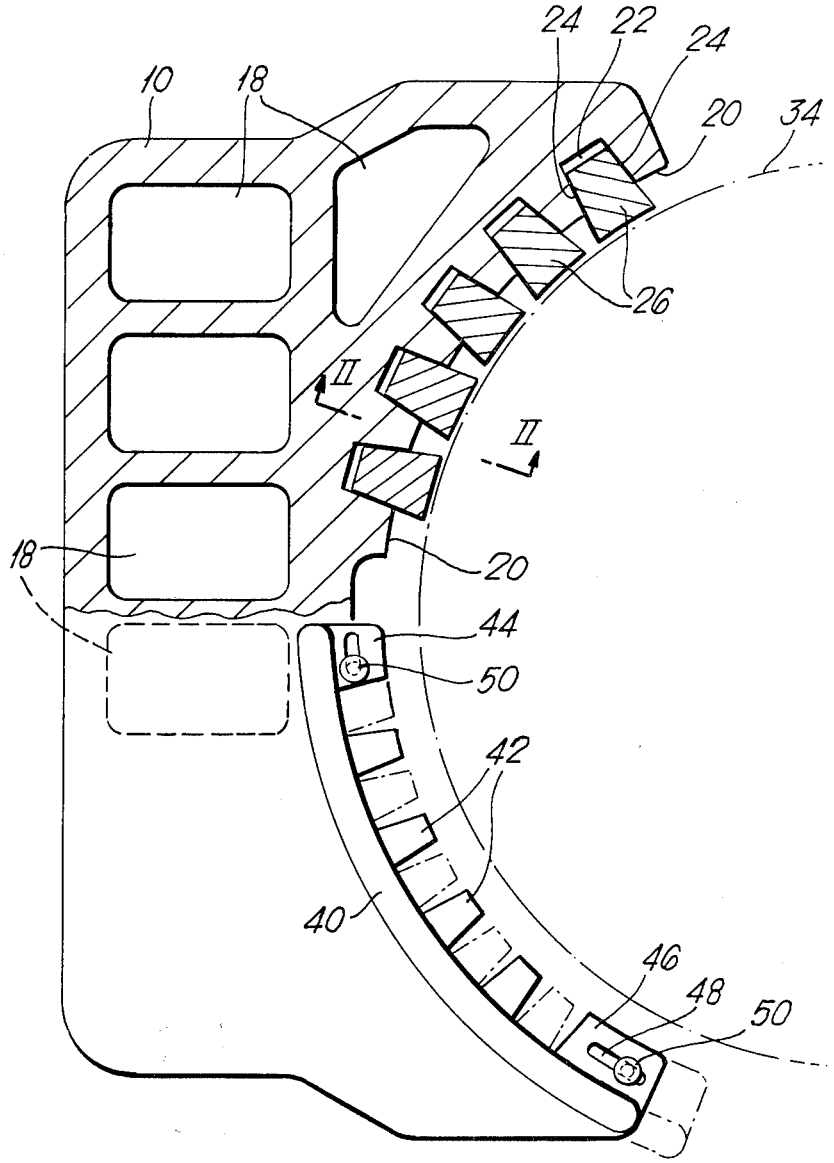
FIG. 1 is a plan view, the top half in section, of one form of clamp for a cylindrical graphite electrode incorporating a contact assembly according to the present invention.
Figure 2:
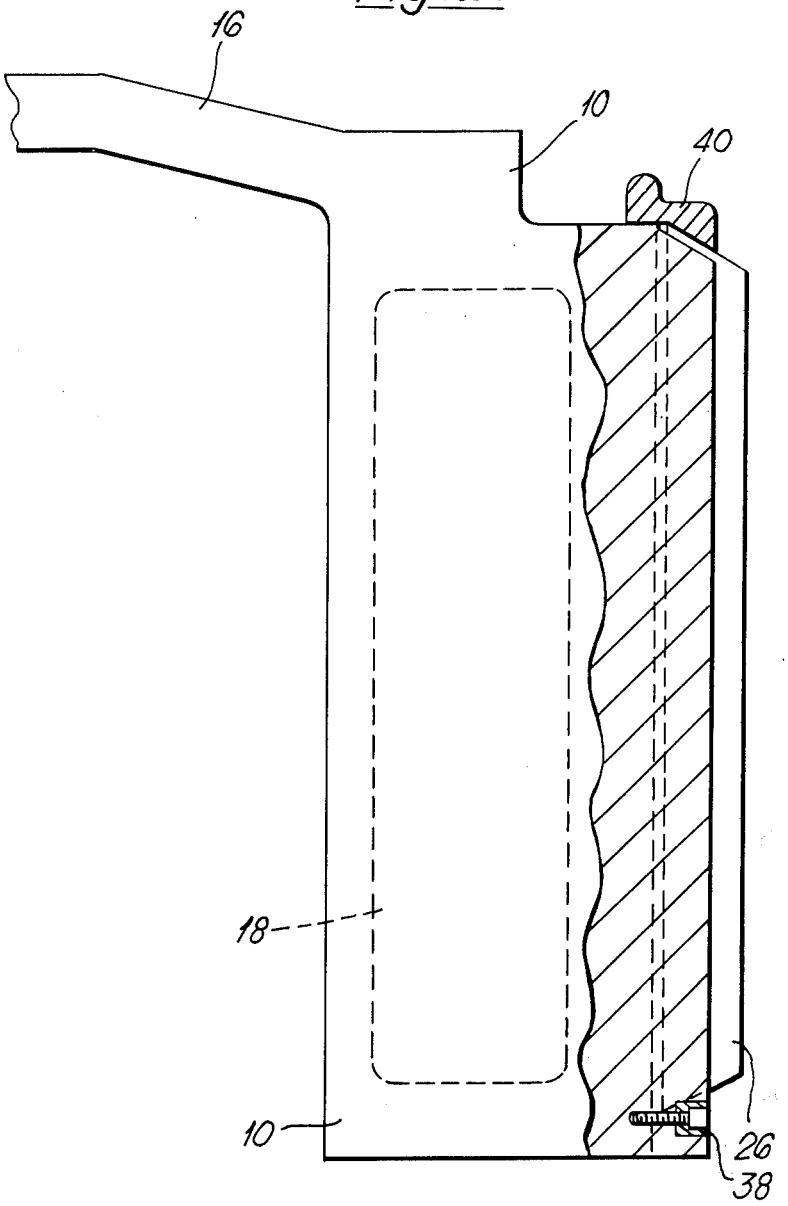
FIG. 2 is a side view, partly sectioned on the line II—II of FIG. 1.

FIGS. 1 and 2 show an electrode clamp according to the present invention. The body 10 of the clamp is made from cast copper with the usual bus tube connection 16 and is provided with water passages 18, the construction of which will be well-known to those skilled in the art.

The body 10 is formed with ten longitudinal, vertical grooves 22 in its cylindrical electrode clamping face 20. The side walls 24 of each groove are planar and form between them a small included angle so that each groove is a wedge-shaped recess. In each recess is placed a graphite insert 26, as shown in the upper part of FIG. 1. Each insert, seen in detail in FIGS. 3 and 4, is similarly wedge-shaped to the grooves 22 with side faces 28 having the same included angle as the side walls 24 of the groove. The rear face 30 can be planar and the front face 32 given a curved surface of the same radius as the outer surface of an electrode which is to be clamped. An outline of part of such an electrode is shown in broken lines at 34 in FIG. 1. The ends 36 of the inserts are chamfered, so that the inserts can be held in position by a bottom retainer 38 made of non-magnetic steel and upper aluminium bronze retainers 40.

When the clamp is to be used for clamping an electrode, the inserts 26 are comparatively loosely wedged in the wedge-shaped grooves 22. When clamping pressure is applied between the clamp shown in FIG. 1 and a clamping band on the other side which is not illustrated, the clamping pressure between the clamp and the electrode forces the inserts 26 into their respective grooves and creates good electrical contact on the one hand between the electrode and the inserts and between the inserts and the clamp.

The function of the bottom and top retainers 38 and 40 is of course to hold the inserts in position before clamping pressure is applied. As seen in FIG. 1 there are two top clamps 40, each comprising an aluminium bronze member which is cast with four inwardly directed fingers 42 and two inwardly directed flanges 44,46 at the ends, these flanges having slots 48 which enable the retainer to be held in position under spring loading from headed bolts 50 screwed into the clamp body 10.

Of the five graphite inserts 26 which are retained by each retainer 40, four of the inserts are held by the fingers 42 and one by the end flange 46. When it is desired to remove one of the inserts, it is only necessary to slide the upper retainer so that the fingers 42 on the one hand and the flange 46 on the other hand move away from the top of the respective inserts, after which the insert can be removed by inserting a suitable instrument behind it, i.e. between the rear of the insert and the end of the groove, and wedging the insert outwards.

The included wedge angle between the side walls 24 of the grooves 22 and the side faces 28 of the inserts 26 should be sufficiently high to ensure the adequate contact which is required and sufficiently low to permit the slight movement which is necessary when the clamping is effected. In theory the optimum angle might well differ as between the grooves which are nearer the centre of the clamp and those which are nearer the two ends, since any movement of the clamp towards the electrode will cause greater movement of the central insert than those at the ends. On the other hand, it would be a disadvantage of having different wedge angles that the inserts would not be interchangeable from one groove to another. At present we prefer to have the same angle for each of the grooves and an included angle of 14° has been found to be satisfactory with one particular grade of graphite.

As can be seen from FIG. 1, the effect of the wedge-shaped inserts is to provide a large contact surface with the electrode where the larger front faces 32 of the inserts contact the outer periphery of the electrode. It can be readily seen that the clamp which is shown in the drawings could be made with a smaller number of larger inserts or a larger number of smaller inserts. Where there are a large number of inserts it may even be found unnecessary to form the front surfaces with a cylindrical surface.

FIG. 5 shows the upper end 52 of a stainless steel bar which is welded to the top of the steel billet (not shown) which becomes an electrode in the electro slag refining process. To the upper end of the stainless steel bar 52 is welded a stainless steel pad 54 which is 50 mm in height, 356 mm in length and 240 mm in breadth. Four wedge-shaped grooves 58 are located lengthwise through the upper face 56 of the bar 54 and in each of these grooves is a wedge-shaped insert 60. As with the arrangement of FIGS. 1 to 4, the inserts 60 have their lower end spaced from the end of the groove and the upper end proud of the face 56 as seen in FIG. 5. In this case the electric supply is from a stub clamp the underface of which is flat (this stub clamp being indicated as 62 in chain lines in the drawings) and in consequence the upper end of each insert 60 presents a flat face to register with the flat bottom face of the stub clamp. When pressure is applied to the stub clamp in order to weight it down onto the pad 54, good electrical contact is made with the inserts 60; if any of these are initially standing proud of the others, the effect of the clamping pressure is to push it down into its groove so as to level out the top surfaces to the level of the lower face of the stub clamp whilst maintaining excellent electrical contact both with the stub clamp and with the pad 54.

In both forms of the invention illustrated, the inserts are substantially trapezoidal in cross-section, providing side faces which are angled in relation to each other, a rear face, and a larger front face which is to make contact with a conducting element.

I claim:

1. A contact assembly capable of passing large electric currents comprising a pair of conducting elements disposed face to face, at least one of said conducting elements having a plurality of insert-receiving grooves in its face, each groove having opposed side walls which converge away from the face, a separate graphite insert located in each of the grooves, each insert being formed of an independent body shaped to normally fit between the convergent walls of the associated groove, with its inner end spaced from the bottom of the groove and its outer end protruding from the face of said conducting element, to make electrical contact with the face of the other one of the conducting elements, and means for pressing the two conducting elements towards each other sufficient to push the most protruding ones of said inserts into their associate grooves until substantially all of said inserts are in contact with the other one of said conducting elements, giving good electrical contact between the graphite inserts and the two conducting elements and thereby a path for the electrical current from one conducting element to the other through the graphite inserts.

2. A contact assembly according to claim 1, wherein one of the conducting elements is a contacting element attached to a steel billet forming an electrode and the other of said conducting elements is a clamp biased towards said contacting element.

3. A contact assembly according to claim 1, having at least four grooves and graphite inserts.

4. A contact assembly according to claim 1, wherein the shape of said groove and of said inserts are identical.

5. A contact assembly according to claim 1, wherein the inserts are substantially trapezoidal in cross-section.

6. A contact assembly according to claim 5, wherein the wedge angle of said inserts is approximately 14°.

7. A contact assembly according to claim 1, wherein one of the conducting elements is the curved body of a clamp and the other of the conducting elements is the rounded surface of an electrode held by the clamp.

8. A contact assembly according to claim 7, wherein the electrode is a cylindrical graphite electrode.

9. A contact assembly according to claim 8, wherein the graphite electrode is coated with aluminum.

10. A conducting element for a contact assembly having a face, a plurality of grooves in the face, each groove having opposed side walls which converge away from the face, an insert located in each of the grooves, each insert being shaped to normally fit between the convergent walls of a groove, and having a rear face and a front face, the rear faces of the inserts being spaced from the bottom of the grooves, and the front faces of the inserts protruding from said face of the conducting element.

11. A conducting element, according to claim 10, wherein the inserts are substantially trapezoidal in cross-section.

* * * * *